US011521818B2

(12) United States Patent
Rosios et al.

(10) Patent No.: US 11,521,818 B2
(45) Date of Patent: Dec. 6, 2022

(54) FUSES AND METHODS OF FORMING FUSES

(71) Applicant: Littelfuse, Inc., Chicago, IL (US)

(72) Inventors: Maria Lily E. Rosios, Batangas (PH); Albert V. Enriquez, Batangas (PH); Victor Oliver L. Tabell, Mandaluyong (PH); Gordon T. Dietsch, Park Ridge, IL (US); Keon Mayson A. Brosas, Laguna (PH)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 17/307,620

(22) Filed: May 4, 2021

(65) Prior Publication Data

US 2021/0257175 A1 Aug. 19, 2021

Related U.S. Application Data

(62) Division of application No. 16/707,095, filed on Dec. 9, 2019, now Pat. No. 11,101,093.

(Continued)

(51) Int. Cl.
*H01H 85/175* (2006.01)
*H01H 85/157* (2006.01)

(Continued)

(52) U.S. Cl.
CPC ..... *H01H 85/175* (2013.01); *H01H 69/02* (2013.01); *H01H 85/055* (2013.01); *H01H 85/157* (2013.01); *H01H 85/1755* (2013.01)

(58) Field of Classification Search
CPC .... H01H 85/175; H01H 69/02; H01H 85/055; H01H 85/157; H01H 85/1755; H01H 85/05; H01H 85/143
See application file for complete search history.

(56) References Cited

U.S. PATENT DOCUMENTS 4,135,587 A 1/1979 Diaz
4,608,548 A * 8/1986 Borzoni ..... H01H 85/0417 337/201

(Continued)

FOREIGN PATENT DOCUMENTS

DE 29709684 U1 9/1997
DE 2015101840 U 6/2015

(Continued)

*Primary Examiner* — Stephen S Sul
(74) *Attorney, Agent, or Firm* — KDB Firm PLLC

(57) ABSTRACT

Exemplary embodiments of the present disclosure of a fuse may include a fuse body having a first portion and a second portion. The first and second portions may be configured to mate together thereby forming an internal cavity. A first inner termination and a second inner termination may be at least partially attachable to the first and second portions of the fuse body at respective first and second ends. A fusible element may be disposed in the cavity of the fuse body and extendable from the first inner termination at the first end of the fuse body to the second inner termination at the second end of the fuse body. The fusible element may be attachable to the first inner termination at a first connection and the second inner termination at a second connection. The first and second connections may be inspectable when the fuse is in an assembled state.

9 Claims, 11 Drawing Sheets

Related U.S. Application Data

(60) Provisional application No. 62/794,730, filed on Jan. 21, 2019.

(51) Int. Cl.
*H01H 69/02* (2006.01)
*H01H 85/055* (2006.01)

(56) References Cited

U.S. PATENT DOCUMENTS 4,646,053 A 2/1987 Mosesian
4,684,915 A 8/1987 Knapp, Jr.
4,703,299 A 10/1987 Vermij
4,851,805 A 7/1989 Poerschke
4,996,509 A * 2/1991 Bernstein ..... H01H 85/143 337/248
5,153,553 A 10/1992 Ruehl
5,994,994 A 11/1999 Ito et al.
6,078,108 A * 6/2000 Froschl ..... H01R 13/637 307/10.7
6,147,585 A * 11/2000 Kalra ..... H01H 85/143 337/248
2002/0113684 A1 8/2002 Arikawa et al.
2005/0035841 A1* 2/2005 Kobayashi ..... H01H 85/0418 337/157
2009/0021339 A1 1/2009 Haas et al.
2009/0045906 A1* 2/2009 Stanek ..... H01H 85/17 337/186
2010/0085141 A1 4/2010 Knab et al.
2010/0102920 A1* 4/2010 Stanek ..... H01H 85/0013 337/186
2010/0245025 A1 9/2010 de Leon et al.
2010/0328020 A1 12/2010 Wiryana et al.
2011/0298577 A1 12/2011 Enriquez et al.
2016/0217960 A1* 7/2016 Abad ..... H01H 85/143
2017/0040134 A1* 2/2017 Arce ..... H01H 69/02
2017/0084415 A1* 3/2017 Nakanishi ..... H01H 85/041
2017/0352514 A1 12/2017 Bruan et al.
2017/0372862 A1 12/2017 Bruan et al.
2018/0061607 A1* 3/2018 Schlaak ..... H01H 85/157
2018/0114663 A1 4/2018 Possnicker
2018/0254163 A1 9/2018 Lee
2020/0013572 A1* 1/2020 Hierl ..... H01H 71/18
2021/0366680 A1* 11/2021 Yoon ..... H01H 37/764

FOREIGN PATENT DOCUMENTS

EP 0144854 A2 6/1985
EP 0423897 A1 4/1991

* cited by examiner

FUSES AND METHODS OF FORMING FUSES

CROSS-REFERENCE TO RELATED APPLICATION

This application is a divisional of, and claims the benefit of priority to, U.S. patent application Ser. No. 16/707,095, filed Dec. 9, 2019, entitled "FUSES AND METHODS OF FORMING FUSES," which claims the benefit of U.S. Provisional Patent Application No. 62/794,730, filed Jan. 21, 2019, which is incorporated by reference herein in its entirety.

FIELD

Embodiments of the present disclosure relate generally to the field of fuses, and more particularly to a fuse configured to facilitate visible inspection of a fusible element.

BACKGROUND

Fuse bodies for different applications are commonly configured such that a fusible element is enclosed in a fuse body during assembly and is not visible for inspection of connection points to an electrical conductor. If the fusible link is not properly connected to the electrical conductor, the fuse may be damaged or inoperable, which may lead to failure during an electrical event and damage to sensitive electrical components. Additionally, fuses may include several separate components requiring welding or soldering for assembly, thereby complicating and increasing the cost for assembly/dis-assembly of the fuse, as well as introducing additional potential failure points of the fuse.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

According to an exemplary embodiment of the present disclosure, a fuse may include a fuse body having a first portion and a second portion. The first and second portions may be configured to mate together thereby forming an internal cavity. A first inner termination may be at least partially attachable to the first and second portions of the fuse body at a first end. A second inner termination may be at least partially attachable to the first and second portions of the fuse body at a second end. A fusible element may be disposed in the cavity of the fuse body and extendable from the first inner termination at the first end of the fuse body to the second inner termination at the second end of the fuse body. The fusible element may be attachable to the first inner termination at a first connection and the second inner termination at a second connection such that the first and second connections may be inspectable when the fuse is in an assembled state.

In various and foregoing embodiments of the present disclosure, a first outer termination may be positioned over the first inner termination at the first end of the fuse body. A second outer termination may be positioned over the second inner termination at the second end of the fuse body. The first outer termination, the second outer termination, the first inner termination, or the second inner termination, or combinations thereof, may be formed as a cap, a clip, or a metallization, or combinations thereof. A contour of the cavity may be narrower at the first and second ends of the fuse body, and wider in a central portion of the fuse body. The first and second inner terminations may be formed to mate with the respective first and second ends of the fuse body. The first and second ends of the fuse body may have a conical curvature extending into the cavity of the fuse body, and the inner terminations may have respective mating conical curvatures, such that the fusible element may be insertable and centered in the cavity. The first and second inner terminations may be crimped onto the respective first and second ends of the fuse body via grooves. The first and second outer terminations may be crimped onto the respective first and second ends of the fuse body, or the respective first and second inner terminations, or both. The fusible element may be attachable to the respective first and second inner terminations by solder, weld, epoxy, or combinations thereof. The fusible element may be attachable by winding around an outer circumference of the respective first and second inner terminations.

According to an exemplary embodiment of the present disclosure, a fuse may include a fuse body including an elongated body having a first end and a second end. The first end and the second end may each have one or more slots. A fusible element may be extendable from the one or more slots of the first end of the fuse body to the one or more slots of the second end of the fuse body. A cover may be included to at least partially enclose the fuse body and the fusible element. The cover may have one or more lockable features to at least partially retain the fuse body, the fusible element, or both.

In various of the foregoing and other embodiments of the present disclosure, a first electrical conductor may be disposed at the first end of the fuse body. A second electrical conductor may be disposed at the second end of the fuse body, and the fusible element may be attachable to the first electrical conductor and extendable along the elongated body of the fuse body and attachable to the second electrical conductor. The fuse body may be formed of an electrically conductive material such that the fusible element may be directly connectable to the fuse body. A first slot may be disposed on a top surface of the first end of the fuse body, and a second slot may be disposed on a top surface of the second end of the fuse body, such that the fusible element may be centered along the fuse body. At least a portion of a first electrical conductor may be positioned in the first slot and at least a portion of a second electrical conductor is positioned in the second slot, and the fusible element may be attachable to the first electrical conductor in the first slot and the second electrical conductor in the second slot. The first slot may be disposed on a first side surface of the first end of the fuse body, and a second slot may be disposed on a first side surface of the second end of the fuse body. At least a portion of a first electrical conductor may be positioned in the first slot and at least a portion of a second electrical conductor is positioned in the second slot, and the fusible element may be attachable to the first electrical conductor in the first slot and the second electrical conductor in the second slot. A third slot may be disposed on a second side surface opposite the first slot on the first side surface of the first end of the fuse body, and a fourth slot may be disposed on a second surface opposite the first slot of the first side surface of the second end of the fuse body. The first side surface of the first end of the fuse body may be opposite of the first side surface of the second end of the fuse body, such that the fusible element may be diagonally extendable along the elongated body of the fuse body. The fusible element may be attachable to the fuse body, the first electrical conductor, the second electrical conductor, or combinations thereof, by solder, weld, epoxy, winding, forming, or combinations thereof.

BRIEF DESCRIPTION OF THE DRAWINGS

By way of example, specific embodiments of the disclosed device will now be described, with reference to the accompanying drawings, in which.

DETAILED DESCRIPTION

Figure 1A:
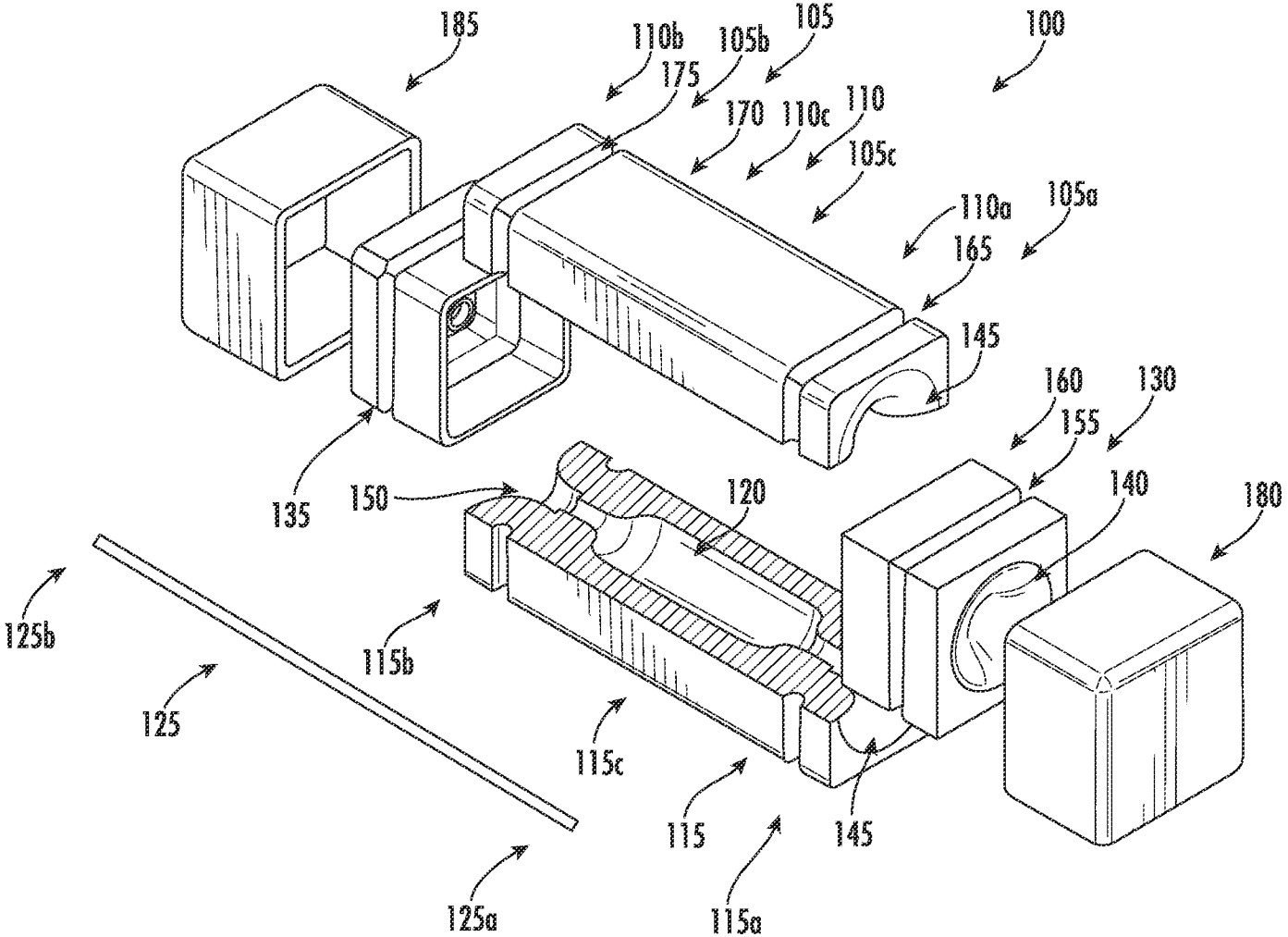
FIGS. 1A-1B illustrate exemplary embodiments of a fuse in accordance with the present disclosure.

A fuse in accordance with the present disclosure will now be described more fully hereinafter with reference to the accompanying drawings, in which certain exemplary embodiments of the fuse are presented. The fuse may be embodied in many different forms and is not to be construed as being limited to the embodiments set forth herein. These embodiments are provided so that this disclosure will be thorough and complete, and will fully convey the scope of the fuse to those skilled in the art. In the drawings, like numbers refer to like elements throughout unless otherwise noted.

Figure 1B:
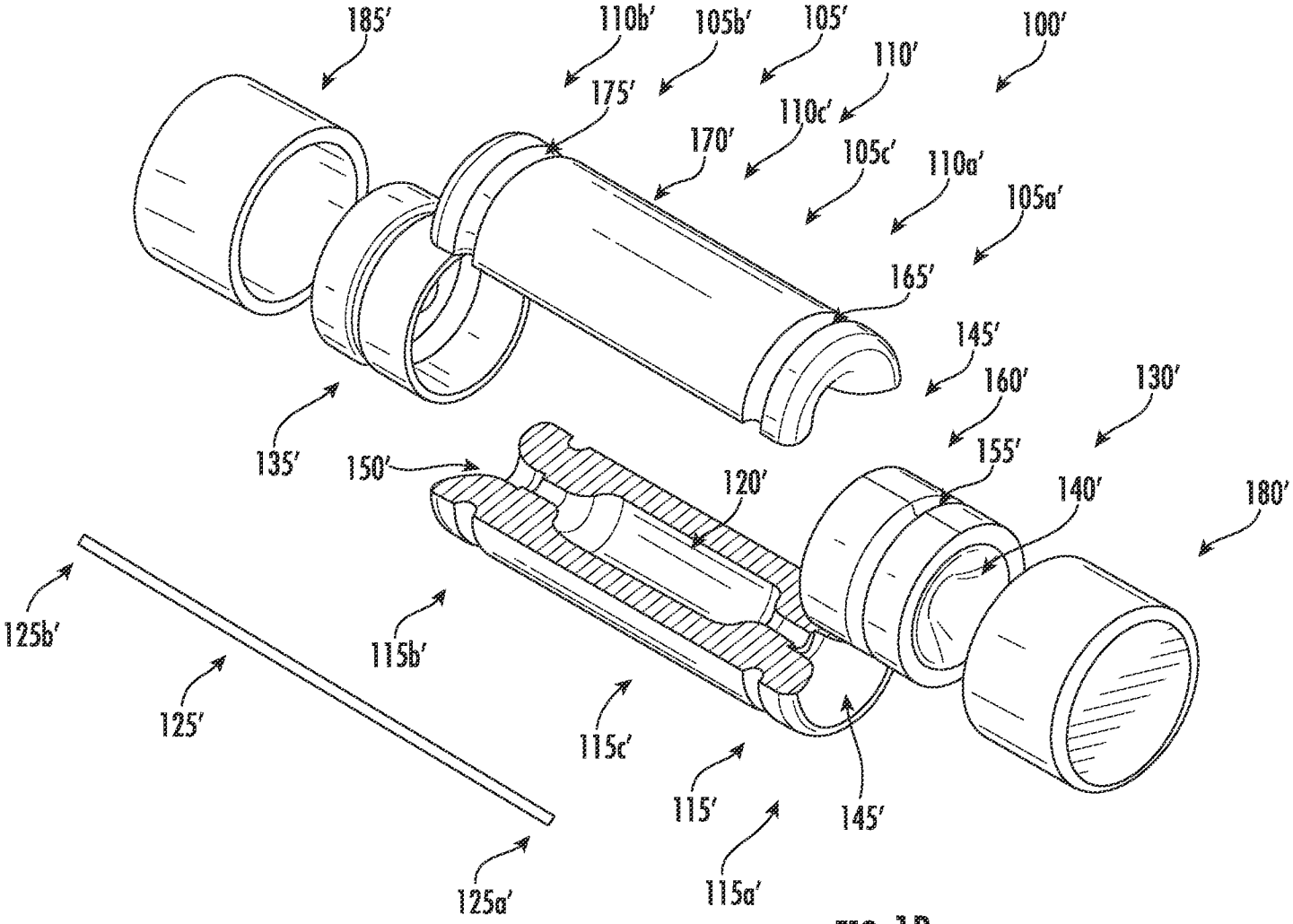

FIGS. 1A-1B and 2A-2B illustrate exemplary embodiments of a fuse in accordance with the present disclosure. Exemplary embodiments of the fuse in the present disclosure may include a cartridge fuse and/or a surface mount fuse. A fuse 100, 100' may include a fuse body 105, 105'. The fuse body 105, 105' may be formed of a single piece (see FIGS. 3A-3C), although in some embodiments the fuse body 105, 105' may be formed of more than one component, e.g., a split body. As shown in FIGS. 1A-1B and 2A-2B, the fuse body 105, 105' may include a first portion 110, 110' and a second portion 115, 115'. The fuse body 105, 105 may be an elongated body, and may have a first end 105*a*, 105*a'*, a central portion 105*c*, 105*c'* and a second end 105*b*, 105*b'*. Similarly, the first portion 110, 110' may be an elongated body and may have a first end 110*a*, 110*a'*, a central portion 110*c*, 110*c'*, and a second end 110*b*, 110*b'*, and the second portion 115, 115' may be an elongated body and may have a first end 115*a*, 115*a'*, a central portion 115*c*, 115*c'*, and a second end 115*b*, 115*b'*. In embodiments, the first and second portions 110, 110', 115, 115' may be symmetrical to define a single fuse body when assembled. For example, the respective first ends 110*a*, 110*a'*, 115*a*, 115*a'* may be aligned to each other, and the respective second ends 110*b*, 110*b'*, 115*b*, 115*b'* may be aligned to each other. As shown in FIG. 1A, the fuse body 105 may be formed in a substantially rectangular shape, and FIG. 1B illustrates the fuse body 105' being formed in a substantially cylindrical shape, although the fuse body may be configured in any shape in accordance with the present disclosure. It is understood that discussion of the fuse body 105, 105' throughout may also include each of the first and second portions 110, 110', 115, 115' (e.g., reference to a first end of the fuse body 105*a*, 105*a'* may include a first end of the first portion 110*a*, 110*a'* and a first end of the second portion 1 115*a*, 115*a'*, etc.).

The fuse body 105 may be formed of a non-conductive material, such as ceramic or a plastic or composite material. In some embodiments, as described below with respect to FIGS. 5B, 6B-6D, at least a portion of the fuse body may be formed of a conductive material, such that the fuse may not require a separate electrical conductor.

The fuse body 105, 105' may have an internal cavity 120, 120'. In some embodiments, the cavity 120, 120' may be at least partially formed in each of the first and second portions 110, 110' 115, 115' although it is understood that the cavity 120, 120' may be wholly disposed in either of the first or second portions 110, 110', 115, 115' of the fuse body 105, 105'. The cavity 120, 120' may extend from the first end 105*a*, 105*a'*, through the fuse body and to the second end 105*b*, 105*b'*, and may be any shape formed in the fuse body 105, 105'. In embodiments, the cavity 120, 120' may have a contour such that at least a portion of the cavity at the first end 105*a*, 105*a'* and/or the second end 105*b*, 105*b'* may be narrower than the cavity at the central portion 105*c*, 105*c'*. In some embodiments, the cavity 120, 120' may be configured to receive a fusible element 125, 125', such that having a narrower cavity portion at the first and/or second ends of the fuse body 105*a*, 105*a'*, 105*b*, 105*b'* may be advantageous for alignment of the fusible element 125, 125' during assembly.

The fusible element 125, 125' may be positioned in the cavity 120, 120' such that the fusible element 125, 125' is centered relative to the fuse body 105, 105'. In some embodiments, the fusible element 125, 125' does not contact the fuse body 105, 105', e.g., the fusible element 125, 125' is surrounded by air. In some embodiments, a filler may be included to fill the cavity 120, 120', such as silica, sand, or other arc-quenching material.

The fusible element 125, 125' may be a wire, a stamped element, or other conductive component, may be formed straight, or include one or more curvatures, and may be extendable in the cavity 120, 120' of the fuse body 105, 105' and attachable at a first end 125*a*, 125*a'* and a second end 125*b*, 125*b'*. The fusible element 125, 125' may be attachable to a first electrical conductor 130, 130' to form a first connection, and a second electrical conductor 135, 135' to form a second connection. In some embodiments, the fusible element 125, 125' may be attachable to the first and second electrical conductors 130, 130', 135, 135' by weld, solder, epoxy, or combinations thereof. The fusible element 125, 125' may be inserted and/or attached to the first and second electrical conductors 130, 130', 135, 135' after the electrical conductors have been attached to the fuse body 105, 105'. In some embodiments, the solder or weld may be lead (Pb) free. In some embodiments, the fusible element 125, 125' may be attachable to the first and second electrical conductors 130, 130', 135, 135' by winding, or wrapping, a respective end 125*a*, 125*a'*, 125*b*, 125*b'* of the fusible element around the respective first and second electrical conductor 130, 130', 135, 135'.

The first and second electrical conductors 130, 130' 135, 135' may be formed as a termination, or an inner cap, e.g., extending over and at least partially enclosing a first end 105*a*, 105*a'* of the fuse body and a second end 105*b*, 105*b'* of the fuse body. The electrical conductors may be referred to as termination and/or inner caps interchangeably, and may be a cap, clips, or metallization, or combinations thereof. In embodiments having a first portion 110, 110' and a second portion 115, 115' of the fuse body 105, the inner cap 130, 130', 135, 135' may clamp, or retain, the respective portions 110, 110', 115, 115' in alignment thereby defining the fuse body 105, 105'. In this manner, the fuse body may be formed without solder, e.g., a solderless, fuse body.

In embodiments, the first and second inner caps 130, 130', 135, 135' may be formed to mate with the respective first and second ends of the fuse body 105*a*, 105*a'*, 105*b*, 105*b'*. For example, the first and second inner caps 130, 130' 135, 135' may have a conical curvature 140, 140' extending inwardly into the respective cap. The conical curvature 140, 140' may be configured to mate with the respective first end and second end of the fuse body 105*a*, 105*a'*, 105*b*, 105*b'*. For example, the first end 105*a*, 105*a'* (e.g., the first ends 110*a*, 115*a*, 110*a'*, 115*a'*) may have a matching conical curvature 145, 145', and the second end 105*b*, 105*b'* (e.g., the second ends 110*b*, 115*b*, 110*b'*, 115*b'*) may have a matching conical curvature 150, 150' such that the inner caps may substantially fit over the respective ends of the fuse body, e.g., as indicated by direction arrows "A". The conical curvature 145, 145', 150, 150' may also extend inwardly towards the central portion 105*c* of the fuse body.

The conical curvature 145, 145', 150, 150' may transition into the cavity 120, 120'. As described above, the narrower portions of the cavity 120, 120' may extend at least partially to the conical curvature 145, 145', 150, 150'. In some embodiments, the conical curvature 140, 140' of the inner caps 130, 130', 135, 135' and/or the conical curvature of the fuse body 145, 145', 150, 150' are formed in a trumpet bell shape. In some embodiments, the conical curvature 140, 140' of the inner caps 130, 130', 135, 135' and/or the conical curvature of the fuse body 145, 145', 150, 150' may aid in alignment of the fusible element 125, 125', such that the fusible element 125, 125' is centered in the fuse body 105, 105'.

Figure 2A:
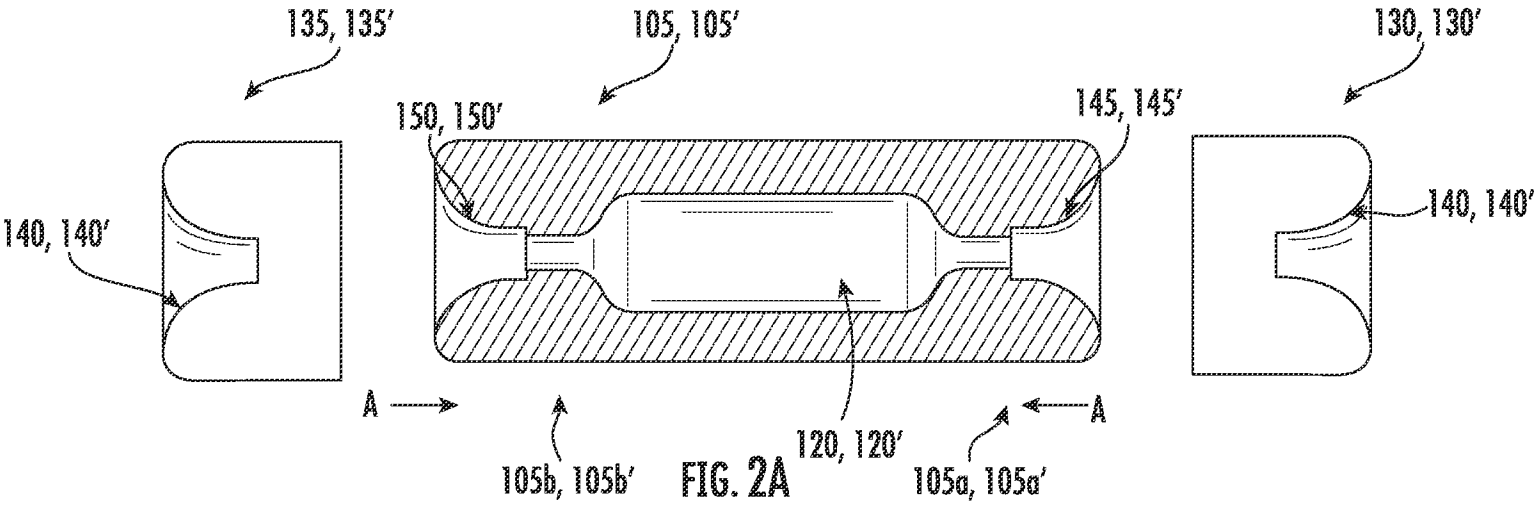
FIG. 2A illustrates a top sectional view of an exemplary embodiment of a fuse in accordance with the present disclosure.
Figure 2B:
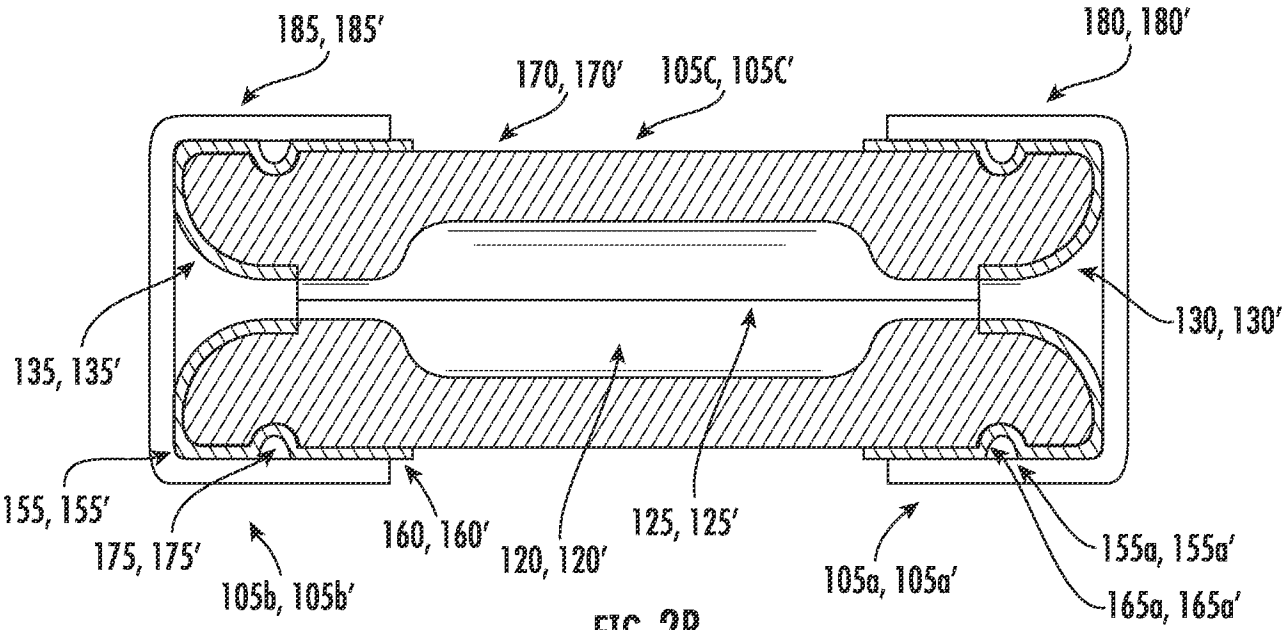
FIG. 2B illustrates a side sectional view of an exemplary embodiment of a fuse in accordance with the present disclosure.

In some embodiments, the inner cap 130, 130', 135, 135' may be crimped onto the respective end 105*a*, 105*a'*, 105*b*, 105*b'* of the fuse body. The inner cap 130, 130', 135, 135' may have a pre-formed groove 155, 155' extending around an outer circumference 160, 160'. Similarly, a first groove 165, 165' may be pre-formed on an outer circumference 170, 170' at the first end 105*a*, 105*a'* of the fuse body, and a second groove 175, 175' may be pre-formed on the outer circumference 170, 170' at the second end 105*b*, 105*b'* of the fuse body. In some embodiments, the grooves may not be pre-formed, but may be created when the inner cap is attached, e.g., crimped to the fuse body. As shown in FIG. 2B, the groove 155, 155' may be configured to lock into the respective first and second grooves 165, 165', 170, 170', thereby clamping, or retaining the fuse body 105, 105' by the inner caps 130, 130', 135, 135'. In some embodiments, the grooves 155, 155', 165, 165', 170, 170' may be formed after assembling the inner caps onto the fuse body, e.g., the inner caps and the fuse body may be crimped together to form the respective grooves.

The inner cap 130, 130', 135, 135' may be shaped to conform to the shape of the fuse body. For example, as shown in FIG. 1A, the inner cap 130, 135 may be rectangular or square in shape to mate with the rectangular fuse body 105. As shown in FIG. 1B, the inner cap 130', 135' may be circular or cylindrical in shape to mate with the cylindrical fuse body 105'.

The electrical conductors 130, 130', 135, 135' (e.g., formed as inner caps) may be formed of an electrically conductive material, such as a metal, including but not limited to brass, copper, copper alloy, gold, silver, or tin, or alloys thereof. In some embodiments, the material may be plated with an electrically conductive material.

As described above, the fusible element 125, 125' may be attached at a first connection to the first inner cap 130, 130' and attached at a second connection to the second inner cap 135, 135'. The conical curvature 140, 140' of the first and second inner caps 130, 130', 135, 135' may aid in alignment of the fusible element 125, 125' for attachment. Additionally, the conical curvature 140, 140' may allow a visual confirmation of the first connection and the second connection. For example, in embodiments where the fusible element is welded, or soldered, to the inner caps 130, 130', 135, 135', it may be advantageous to inspect the joint quality. As described above, previous fuse configurations may not allow for a weld to be inspected, such that the fuse may be damaged or inoperable. The fuse body 105, 105' and the inner cap 130, 130', 135, 135' may be configured such that the first connection and the second connection may be inspectable without removal of the inner cap from the fuse body. In this manner, the first and second portions may remain in alignment and retained by the inner caps.

In some embodiments, a first termination, or outer cap 180, 180' may be positioned over at least a portion of the first inner cap 130, 130', and/or the first end 105*a*, 105*a'* of the fuse body. A second outer termination, or cap 185, 185' may be positioned over at least a portion of the second inner cap 135, 135', and/or the second end 105*b*, 105*b'* of the fuse body. The first and/or second outer terminations may be formed as caps, clips, or metallization, or combinations thereof. In some embodiments, the first and second outer caps 180, 180', 185, 185' may be a press fit, or interference fit, over the respective inner cap 130, 130', 135, 135'. The outer caps may be fixed over the respective inner caps, so that the outer caps may not be removed after assembly. The outer cap 180, 180', 185, 185' may be formed in a shape to conform with the inner cap 130, 130', 135, 135' and/or the fuse body 105, 105'. As shown in FIG. 1A, the first and second outer cap 180, 185 may be substantially rectangular or square to mate with the inner cap 130, 135 and/or the fuse body 105. As shown in FIG. 1B, the first and second outer cap 180, 185 may be substantially cylindrical or circular to mate with the inner cap 130', 135' and/or the fuse body 105'.

Figure 3B:
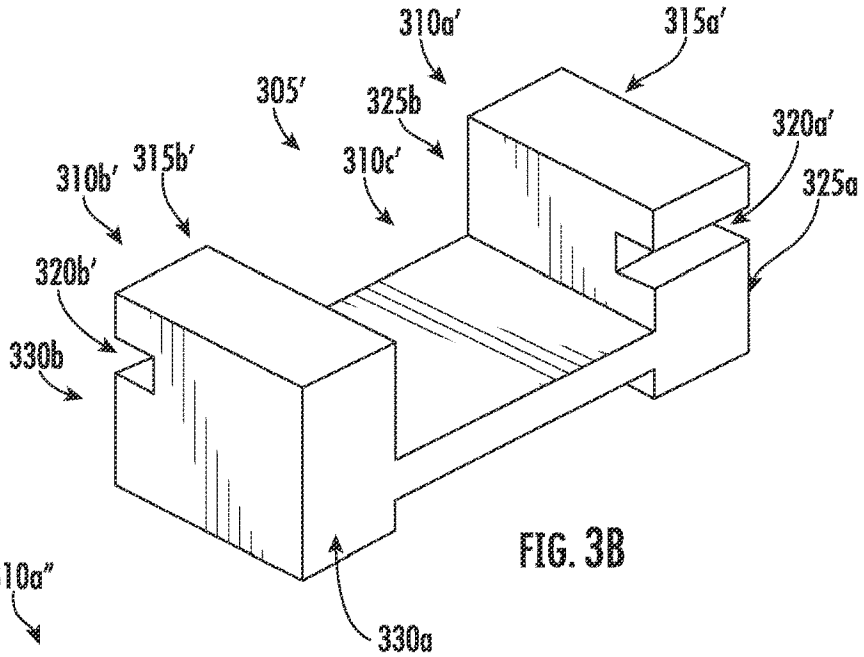
FIGS. 3A-3C illustrate exemplary embodiments of a fuse body in accordance with the present disclosure.
Figure 3A:
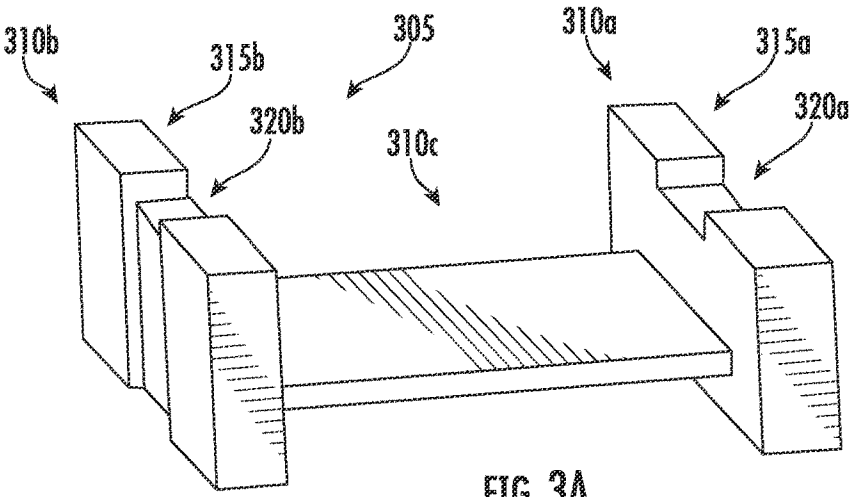
Figure 3C:
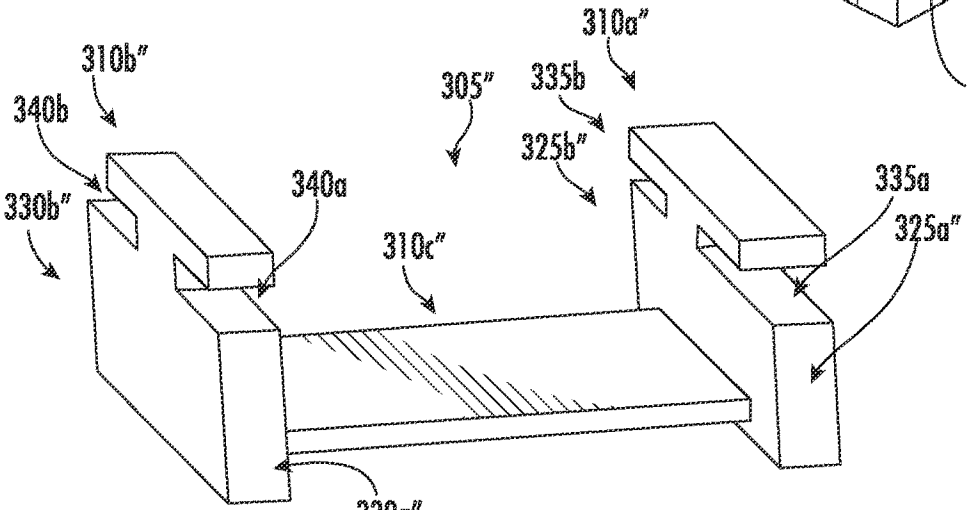
Figure 9A:
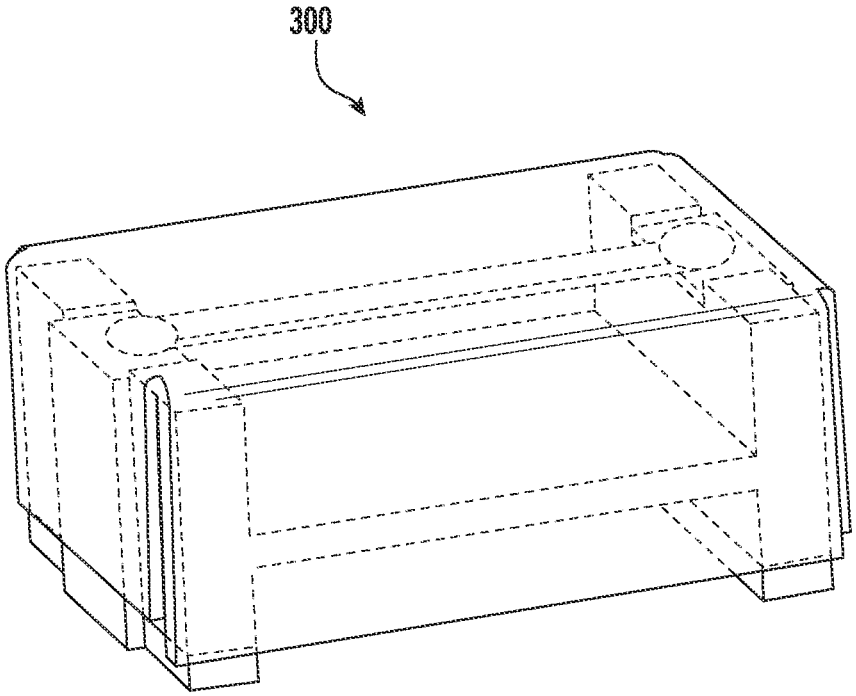
FIGS. 9A-9B illustrate exemplary embodiments of an assembled fuse in accordance with the present disclosure.

Referring now to FIGS. 3A-3C, additional embodiments of a fuse body 305, 305', 305" are shown. As described above, the fuse body may be configured as a solderless design, such that no additional solder is needed to configure a fuse, e.g., fuse 300, 300' of FIGS. 9A-9B. The fuse body may have a first end 310*a*, 310*a'*, 310*a"*, and a second end 310*b*, 310*b'*, 310*b"*, and a central portion 310*c*, 310*c'*, 310*c"* disposed therebetween. The central portion 310*c*, 310*c'*, 310*c"* may be formed as a plate, although any configuration is envisioned to form a fuse body in a desired shape. As described above, the fuse body 305, 305', 305" may be integrally formed, or assembled to form, a single piece, and may be formed of a non-conductive material such as ceramic, plastic or composite or combinations thereof. In some embodiments, the fuse body 305, 305', 305" may be at least partially formed of a conductive material. For example, as shown in FIG. 5B, an electrical conductor 345, 350 formed as conductive plates may be disposed along an edge of the fuse body 305. The fuse body 305, 305', 305" may be substantially rectangular, but it is also envisioned that the fuse body may be any shape as desired for connection with other electrical components.

In embodiments, the first and second ends of the fuse body 310*a*, 310*b*, 310*a*', 310*b*', 310*a*", 310*b*" may include one or more slots, or notches. As shown in FIG. 3A, a first slot 320*a* may be disposed in a first edge 315*a* of the first end of the fuse body, and a second slot 320*b* may be disposed in a second edge 315*b* of the second end of the fuse body. The first and second edges 315*a*, 315*b* may be a top surface of the respective first and second ends of the fuse body, and the first and second slots 320*a*, 320*b* may be a depression, or a recessed area, on at least a portion of the first and second edges 315*a*, 315*b*, at any depth into the first and second edges 315*a*, 315*b*, e.g., to receive at least a portion of an electrical conductor (see FIGS. 5A-6D). The first and second slots 320*a*, 320*b* may be formed in the respective first and second edges 315*a*, 315*b* transversely, e.g., substantially perpendicular to a length of the edge, and/or longitudinally, e.g., along a length of the edge. In some embodiments, the first and second slots 320*a*, 320*b* may extend around the respective ends 310*a*, 310*b* so that each face has a depression, or recessed area.

In some embodiments, slots or notches may be disposed on side faces of the fuse body. As shown in FIG. 3B, a slot 320*a*' may be disposed on a side face 325*a* of a first end 310*a*'. In some embodiments, the slot 320*a*' may be disposed on opposite side face 325*b* of the first end 310*a*'. It is also understood that slots may be disposed on both side faces 325*a*, 325*b* of the first end 310*a*'. Similarly, a slot 320*b*' may be disposed on a side face 330*a* of a second end 310*b*', on opposite side face 330*b* of the second end 310*b*', or both. The first and second slots 320*a*', 320*b*' may be formed in the respective side faces 325*a*, 325*b*, 330*a*, 330*b* transversely, e.g., substantially perpendicular to a length of the fuse body, and/or longitudinally, e.g., substantially parallel to length of the fuse body. The slots 320*a*', 320*b*' may be formed at any position on the side faces 325*a*, 325*b*, 330*a*, 330*b*, e.g., towards edges 315*a*', 315*b*', or the top surfaces of the first and second ends 310*a*', 310*b*', and/or towards a bottom face of the first and second ends 310*a*', 310*b*'. The slots 320*a*', 320*b*' may be at least partially formed as a recess, or depression, into the side faces 325*a*, 325*b*, 330*a*, 330*b*, and may be any depth to receive at least a portion of an electrical conductor (see FIGS. 5A-6D).

As shown in FIG. 3C, slots may be formed into each side face of each end of the fuse body. A first end 310*a*" may have a first slot 335*a* formed into a first side face 325*a*", and a second slot 335*b* formed into a second side face 325*b*". A second end 310*b*" may have a first slot 340*a* formed into a first side face 330*a*" and a second slot 340*b* formed into a second side face 330*b*". Although four slots are shown as being formed as recessions, or depressions, into the side faces, additional or fewer slots are also envisioned. The slots 335*a*, 335*b*, 340*a*, 340*b* may be formed as notches, such that the first end 310*a*" and the second end 310*b*" are T-slots. It is also envisioned that the slots 335*a*, 335*b*, 340*a*, 340*b* may at least be partially formed as a recess, or depression, into the side faces 325*a*", 325*b*", 330*a*", 330*b*", and may be any depth to receive at least a portion of an electrical conductor (see FIGS. 5A-6D).

It is envisioned that the slots 320*a*, 320*b*, 320*a*', 320*b*', 335*a*, 335*b*, 340*a*, 340*b* may be formed into the fuse body as guides for an electrical conductor, such that the electrical conductor is properly aligned for connection with a fusible element. Additionally, the slots may be positioned on the fuse body such that connections between a fusible element and an electrical conductor may be visible for inspection.

Figure 4:
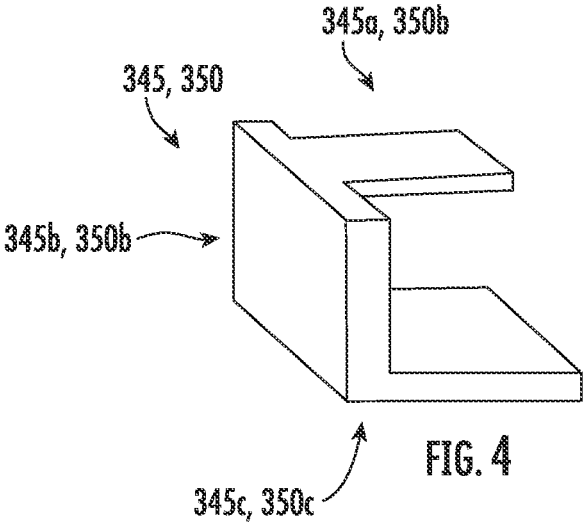
FIG. 4 illustrates an exemplary embodiment of an electrical conductor of a fuse in accordance with the present disclosure.

At least a portion of an electrical conductor may be disposed in the slots 320*a*, 320*b*, 320*a*', 320*b*', 335*a*, 335*b*, 340*a*, 340*b* of the respective fuse body 305, 305', 305". In some embodiments, an electrical conductor 345, 350 may be formed as clip, e.g., a C-clip, and may be attachable to the fuse body. In some embodiments, an electrical conductor 345, 350 may be formed as a coating, e.g., a metallization, of a portion of the fuse body. As shown in FIG. 4, an electrical conductor 345, 350 may include a first top portion 345*a*, 350*a*, a second side portion 345*b*, 350*b*, and a third bottom portion 345*c*, 350*c*, formed as a "C" or "U" shape.

Figure 5A:
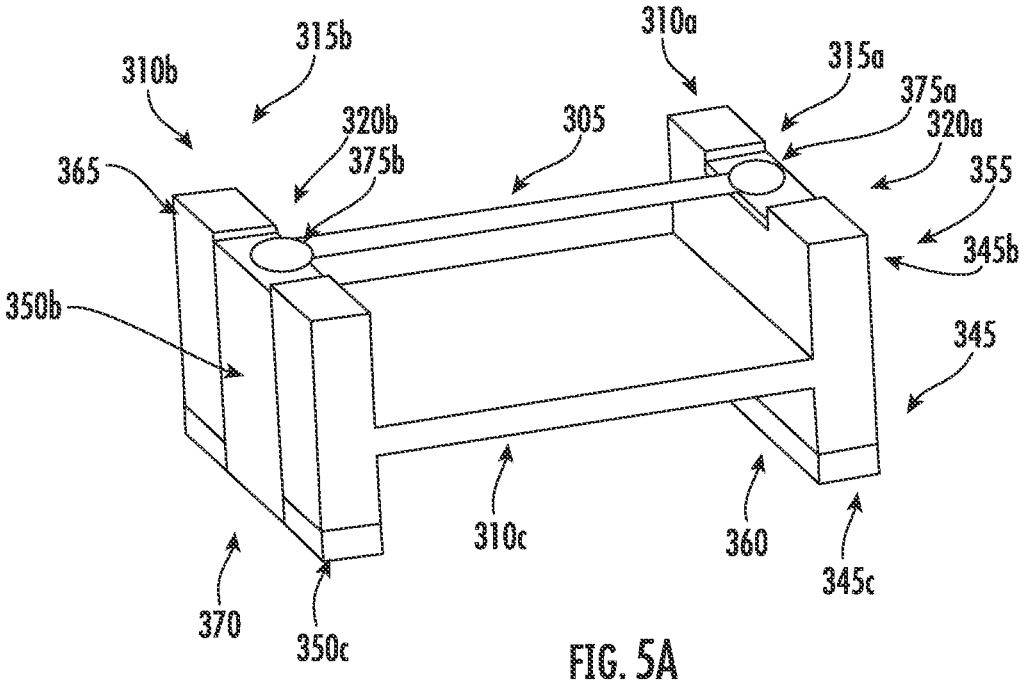
FIGS. 5A-5B illustrate exemplary embodiments of a fuse in accordance with the present disclosure.
Figure 5B:
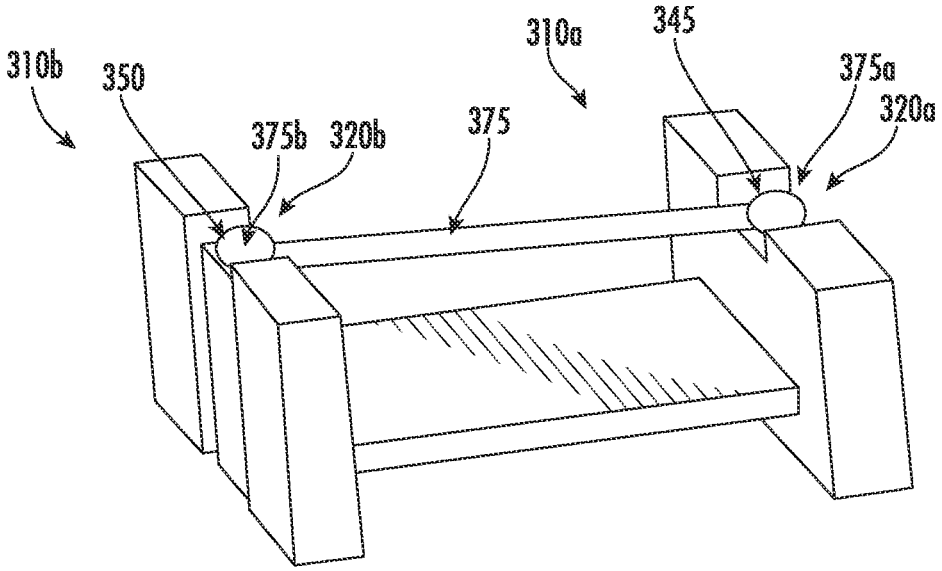

Referring now to FIGS. 5A-5B, a first electrical conductor 345 may be positioned with respect to a first end 310*a*, and a second electrical conductor 350 may be positioned with respect to a second end 310*b*. In some embodiments, the first electrical conductor 345 may be attached to the first end 310*a* of the fuse body such that the first, or top, portion 345*a* is disposed in the first slot 320*a*. The second, or side, portion 345*b* may be in alignment (e.g., substantially parallel) with an outward face 355 of the first end 310*a*. The third, or bottom, portion 345*c* may be in alignment (e.g., substantially parallel) with a bottom face 360 of the first end 310*a*. Similarly, the second electrical conductor 350 may be attached to the second end 310*b* of the fuse body such that the first portion 350*a* is disposed in the second slot 320*b*. The second portion 350*b* may be in alignment (e.g., substantially parallel) with an outward face 365 of the second end 310*b*. The third portion 350*c* may be in alignment (e.g., substantially parallel) with a bottom face 370 of the second end 310*b*. In embodiments, the second portion 350*b* may be formed to fit within the slot 320*a*, 320*b* (see FIG. 5A), e.g., a width of the first portion 345*a* and the second portion 345*b* may be substantially the same. In other embodiments, the second portion 350*b* may substantially extend over and/or cover the respective first and/or second end 310*a*, 310*b* (see FIG. 4), so that a width of the second portion 350*b* may be greater than a width of the first portion 350*b*.

The first and second electrical conductors 345, 350 may be in electrical connection by a fusible element 375. In some embodiments, the fusible element 375 may be attachable to the first electrical conductor 345 at a first end 375*a* to form a first connection and a second electrical conductor 350 at a second end 375*b* to form a second connection. The fusible element may be attachable to the first and second electrical conductors 345, 350 by weld, solder, epoxy, or combinations thereof. In some embodiments, electrical conductors may be integrally formed with a fusible element. FIGS. 7A-7H illustrate exemplary embodiments of a fusible element and/or electrical conductors 700-735, which may be any of a wire, stamped element, or other conductor, and may be straight, coiled, or include one or more curvatures, bends, or formations with respect to the fuse body. It is understood that the electrical conductors may include one or more openings, or pre-formed weak spots (see FIGS. 7C, 7E, 7F), such that in an electrical event, a desired portion may be configured to fail.

As described above, in some embodiments, the fusible element 375 may be attachable to a metallization of a portion of the fuse body, e.g., as shown in FIG. 5B. For example, the first end 375*a* may be attachable at a first slot 320*a*, which may have a coating, metallization, or other electrical conductor 345, 350 as part of the fuse body 305, to form a first connection. Similarly, the second end 375*b* may be attachable at a second slot 320*b*, which may have a coating, metallization, or other electrical conductor as part of the fuse body 305, to form a second connection.

Figure 6A:
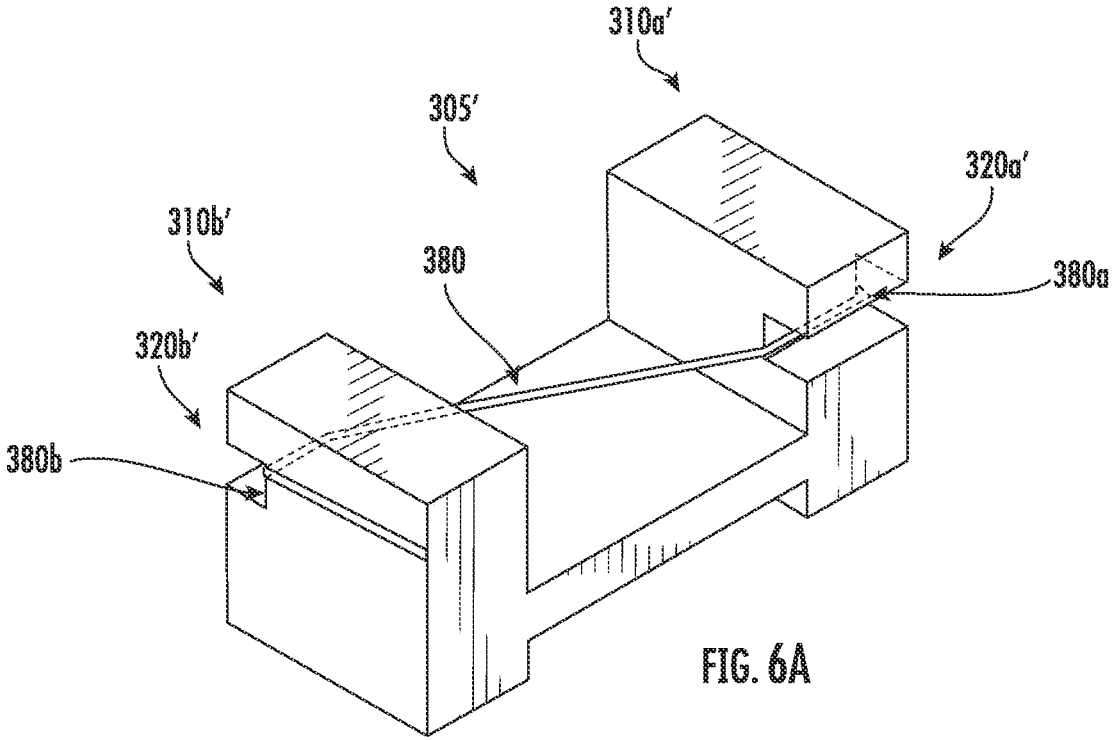
FIGS. 6A-6D illustrate exemplary embodiments of a fuse in accordance with the present disclosure.

In some embodiments, the electrical conductor may be a wire, or stamped element, which may be formable at least partially around the slots 320*a*, 320*b*, 320*a*', 320*b*', 335*a*, 335*b*, 340*a*, 340*b*. As shown in FIG. 6A, a fusible element 380 may be positioned with respect to the fuse body such that a first end 380*a* of the fusible element is disposed in the slot 320*a*', and a second end 380*b* of the fusible element is disposed in the slot 320*b*'. In embodiments where the fuse body has a coating, or metallization of at least a portion of the fuse body (e.g., the slots are formed as electrical conductors), the fusible element may be attached to the fuse body directly via weld, solder, epoxy, or combinations thereof. In some embodiments, the fusible element 380 may be attached to the fuse body by winding, wrapping, or forming, respective first and/or second ends 380*a*, 380*b* around the fuse body 305'. Although FIG. 6A illustrates a fusible element 380 wrapped around slots 320*a*', 320*b*' formed into side faces of the fuse body, it is understood and envisioned that a fusible element may be attachable (e.g., winding, wrapping, forming, welding, soldering, epoxy, or combinations thereof) to a fuse body 305, 305', 305" having slots in any configuration, e.g., slots may be disposed in any of the edges, or top surfaces, and/or side faces.

Figure 6B:
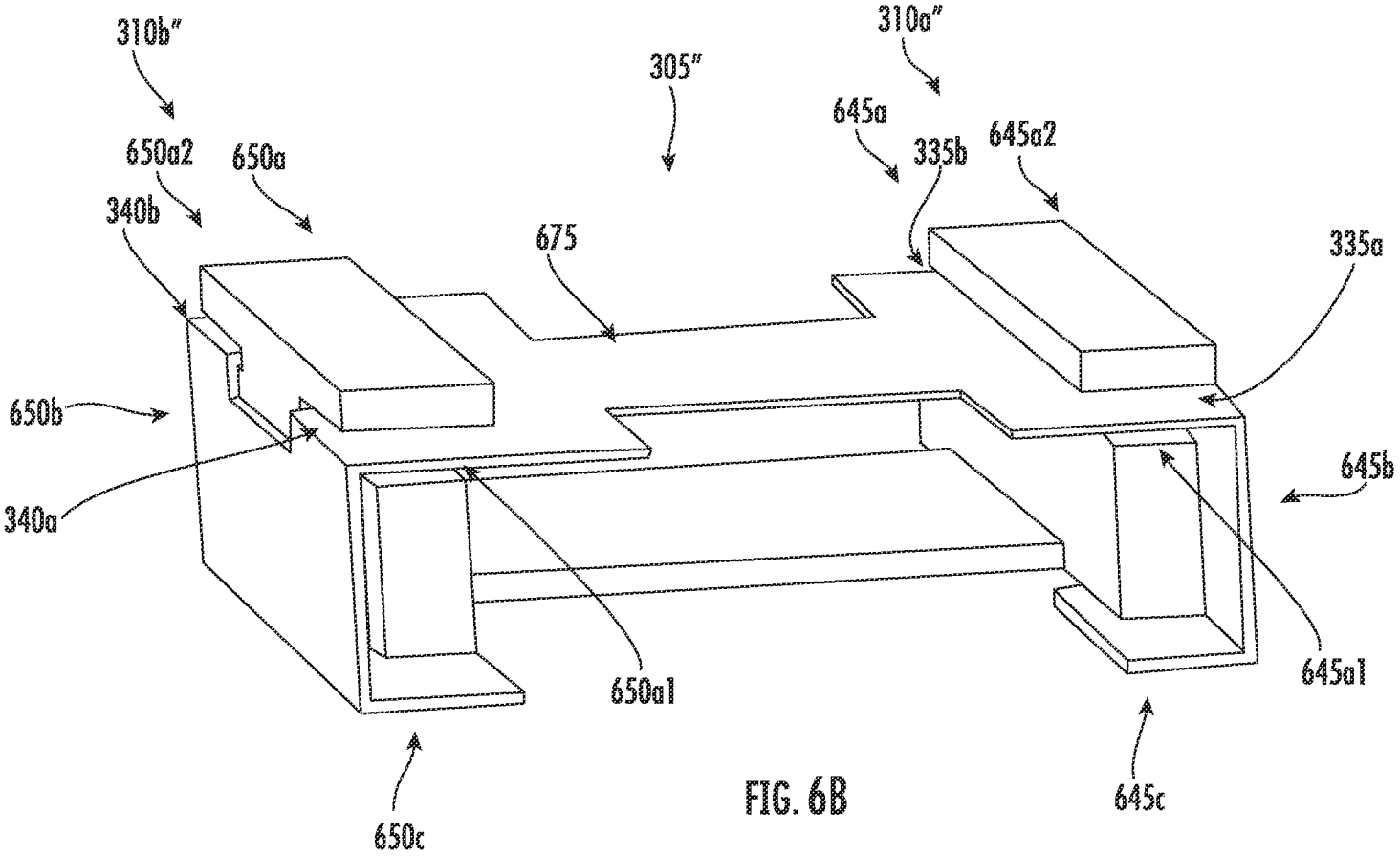

In some embodiments, e.g., fuse body 305" having T-slots formed in the first and second ends 310*a*", 310*b*", electrical conductors may be integrally formed with, or formed as separate components and welded to, a fusible element to attach to the fuse body 305". As shown in FIG. 6B, electrical conductors 645, 650 may be attachable to a fusible element 675, and may be welded, or soldered, together. The electrical conductors 645, 650 may be similar to electrical conductor 345, 350, e.g., formed in a "C" or "U" shape. However, a first out face, or top portion 645*a*, 650*a* may have two prongs, e.g., 645*a*1, 645*a*2, 650*a*1, 650*a*2, to at least partially be received in the slots 335*a*, 335*b*, 340*a*, 340*b* positioned on the side faces of the first and second ends of the fuse body. The prongs may be formed to accommodate the T-slot shape. In embodiments, the fusible element 675 may be configured to attach to the electrical conductor 645, 650. For example, a first end 675*a* may similarly have two prongs to mate with the prongs 645*a*1, 645*a*2, and a second end 675*b* may have two prongs to mate with the prongs 650*a*1, 650*a*2.

Figure 6C:
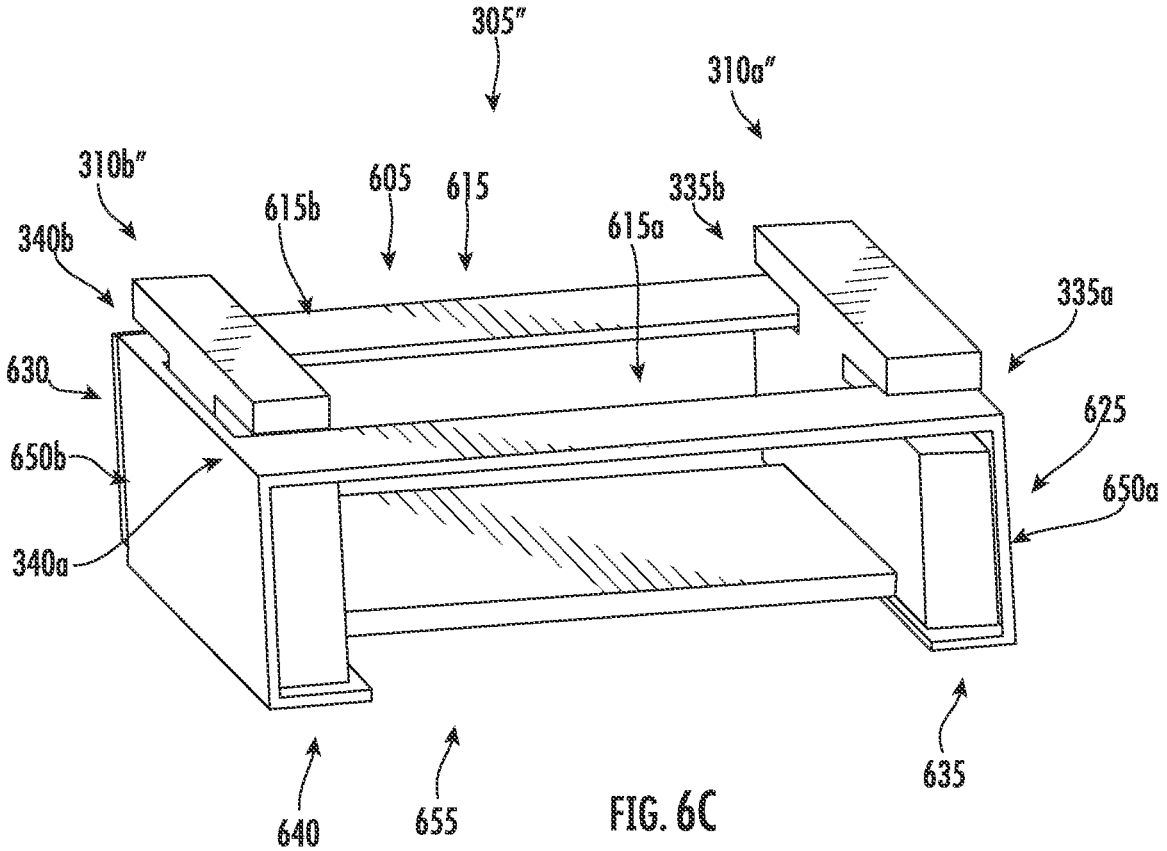
Figure 6D:
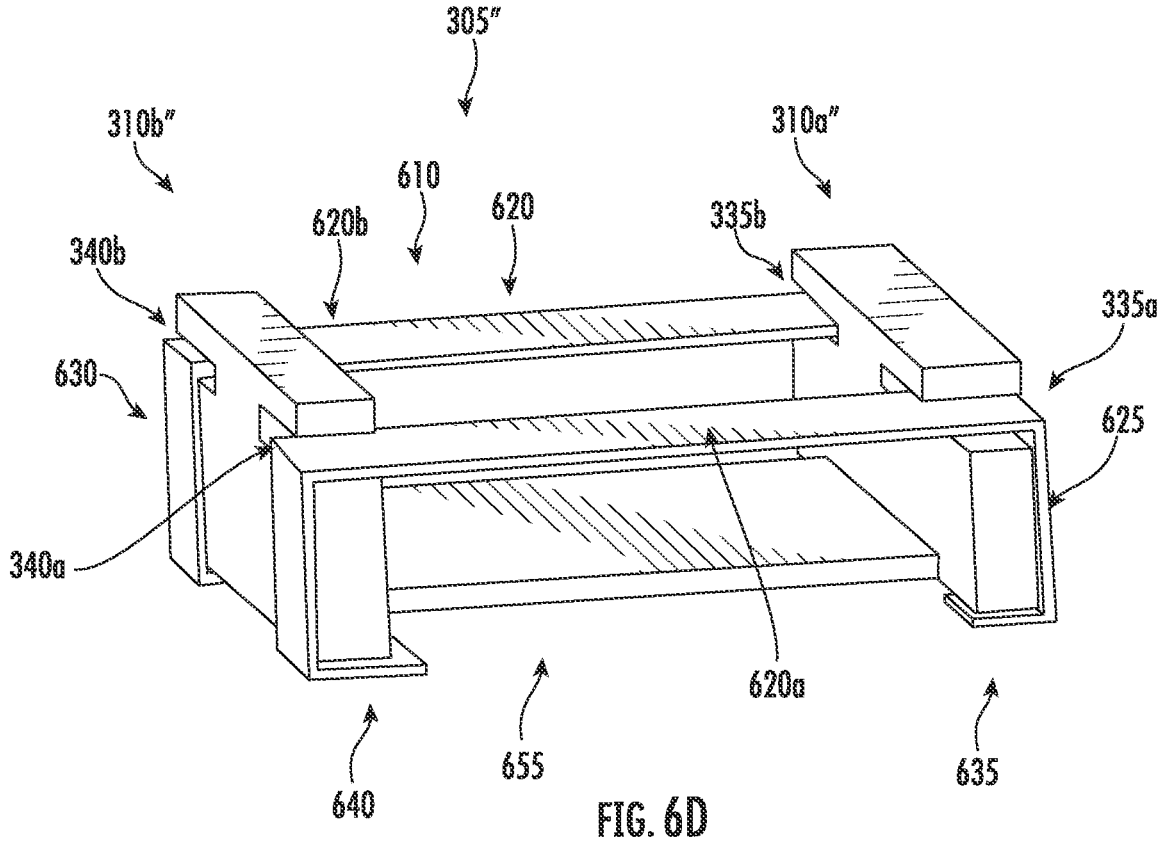
Figure 7A:
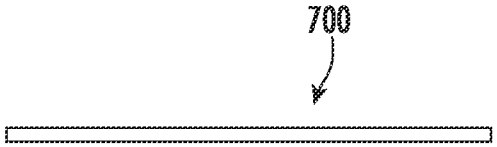
FIGS. 7A-7H illustrate exemplary embodiments of a fusible element in accordance with the present disclosure.
Figure 7B:
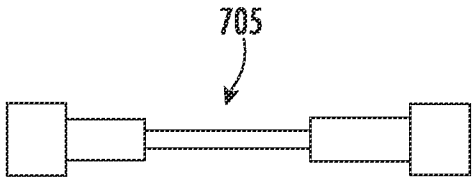
Figure 7C:
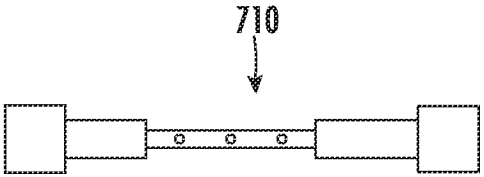
Figure 7D:
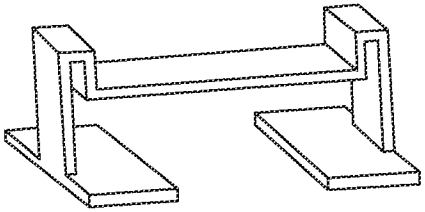
Figure 7E:
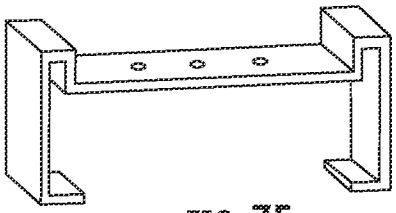
Figure 7F:
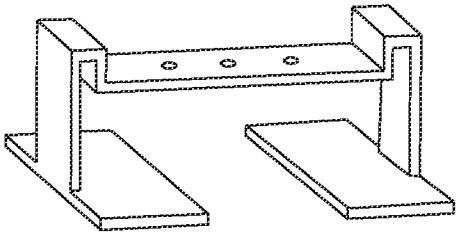
Figure 7G:
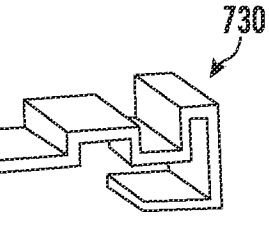
Figure 7H:
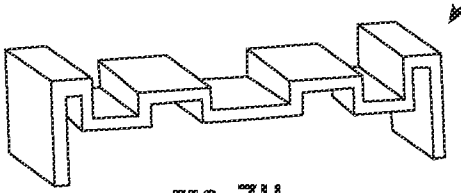

FIGS. 6C-6D illustrate an integrally formed electrical conductor and fusible element, and is referred throughout as the electrical conductor 605, 610. In embodiments, the electrical conductor 605, 610 may be a stamped element, such as a sheet metal, and formed into a shape configured around the fuse body 305". The electrical conductor 605, 610 may have a first portion 615, 620 as prongs, or parallel elements 615*a*, 615*b*, 620*a*, 620*b*, which may extend through the respective slots 335*a*, 335*b*, 340*a*, 340*b*. For example, element 615*a*, 620*a* may extend from the first end 310*a*" through the first slot 335*a* to the second end 310*b*" through the second slot 340*a*. Similarly, element 615*b*, 620*b* may extend from the first end 310*a*" through the third slot 335*b* to the second end 310*b*" through the second slot 340*b*. The elements 615*a*, 615*b*, 620*a*, 620*b* may be substantially parallel to each other and extend longitudinally along the fuse body 305". The first portion 615, 620 may extend into second and third portion, 625 and 630. The second and third portions 625, 630 may be aligned with the respective first and second ends 310*a*", 310*b*", e.g., may extend substantially parallel to an outer face, or top portion 650*a*, 650*b* of the first and second ends 310*a*", 310*b*". In some embodiments, the second and third portions 625, 630 may be a single piece (see FIG. 6C), although in other embodiments, the second and third portions 625, 630 may extend as separate, parallel elements (see FIG. 6D). In some embodiments, a fourth and fifth portion 635, 640 may extend from the respective second and third portion 625, 630 along a bottom face 655 of the fuse body.

The first, second, third, fourth, and fifth portions may be formed by placing the stamped element over the fuse body, e.g., so the first portion is substantially parallel along a top surface of the fuse body, and bending, or forming, the second, third, fourth, and fifth portions accordingly. In embodiments, the second and third portions may be substantially perpendicular to the first portion, and the fourth and fifth portions may be substantially perpendicular to the first portion and the respective second and third portions.

When the electrical conductors and/or fusible elements are attached and positioned as desired with respect to the fuse body, a cover 805, 810 may be positioned over at least a portion of the fuse body, electrical conductor, and/or fusible element. It is understood that prior to assembling the cover 805, 810, any electrical connections, e.g., welds, solder, wrapping, windings, etc., may be visually inspected to verify the attachments.

The cover may be formed to mate with the fuse body, electrical conductor, and/or the fusible element. For example, the cover may be substantially rectangular, e.g., a box-shape, although the cover may be any shape to at least partially enclose the fuse body and other components.

Figure 8B:
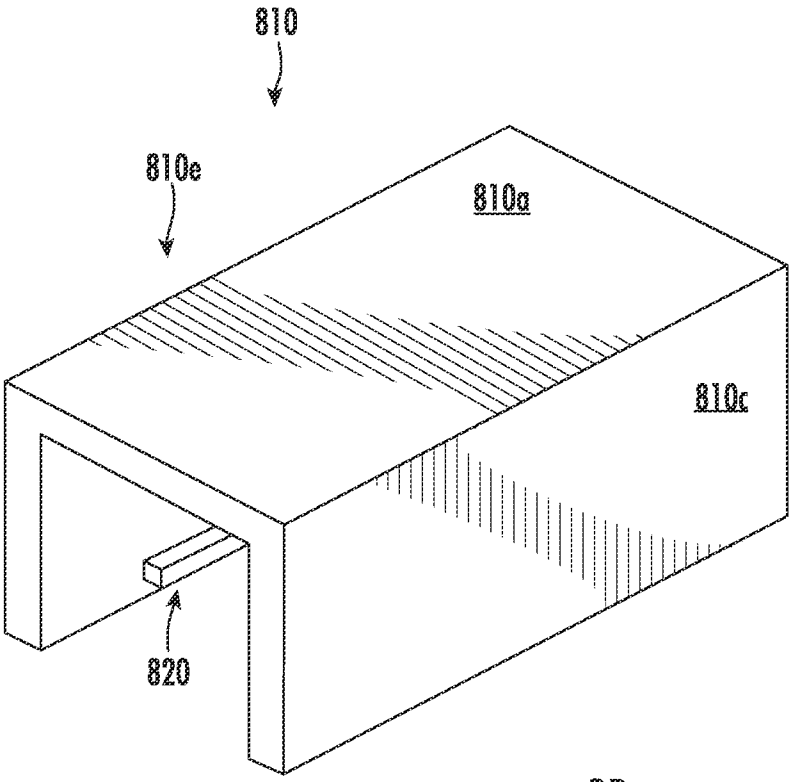
FIGS. 8A-8B illustrate exemplary embodiments of a fuse cover in accordance with the present disclosure.
Figure 8A:
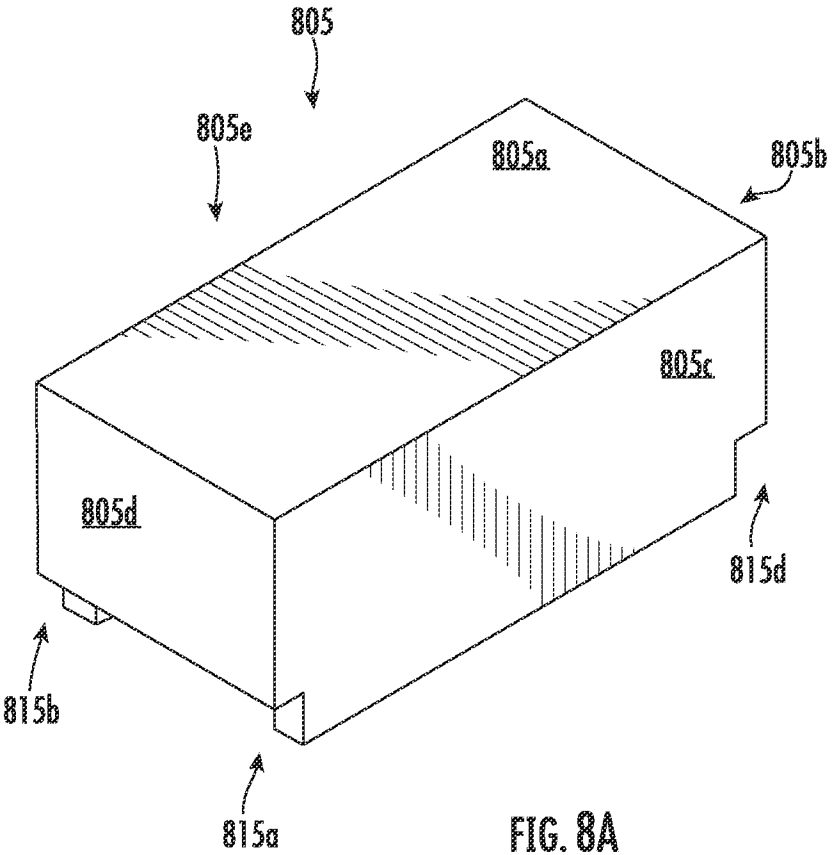

In embodiments, the cover 805 may have a top face 805*a* and surrounding side faces 805*b*-805*e*, such that the cover 805 may be placed over the fuse body 305, 305', 305", electrical conductors 345, 350, 645, 650, 605, 610, and/or fusible element 375, 380, 675. The cover 805 may include one or more locking features 815, e.g., locking features 815*a*-815*d*. The locking features 815*a*-815*d* may be formed in respective corners of the cover 805, as shown in FIG. 8A. The locking features 815*a*-815*d* may be formed to lock, or snap-fit, with the fuse body 305, 305', 305". For example, the locking features 815*a*-815*d* may have protrusions, or recessions, or both, formed to interlock with equivalent recessions, or protrusions, or both, on the fuse body. When the cover is attached to the fuse body, a fuse 300 (see FIG. 9A) may be subsequently connected to other electrical components. As shown, at least a portion of the electrical conductors may be extendable out of the cover for electrically connecting to the other electrical components.

Figure 9B:
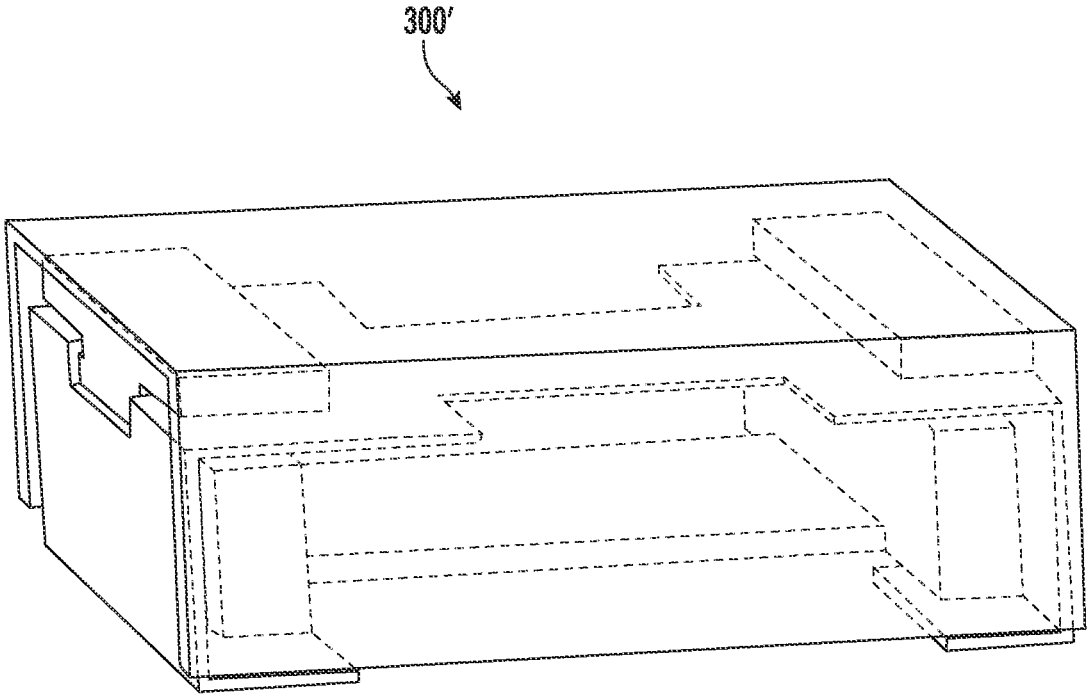

In some embodiments, a cover 810 may have a top face 810*a* and side faces 810*c*, 810*e*, such that end side faces are open, e.g., side faces aligned with the first and second ends of the fuse body. When the cover 810 is attached to the fuse body 305, 305', 305", e.g., as shown in FIG. 9B to form fuse 300', the electrical conductors 345, 350, 645, 650, or portions 625, 630 of conductors may be electrically connectable to other electrical components.

The cover 810 may include locking features 820, e.g., formed on an internal surface of side faces 810*c*, 810*e*. Locking features 820 may be formed as protrusions, recesses, or both, and may be configured to interlock with equivalent recesses, protrusions, or both, on the fuse body. The locking features 820 may be a snap-fit to lock the cover 810 onto the fuse body, to at least partially cover the fuse body, electrical conductors, and/or fusible elements.

The present disclosure is not limited to the particular embodiments described herein. The terminology used herein is for the purpose of describing particular embodiments only and is not intended to be limiting beyond the scope of the appended claims. Unless otherwise defined, all technical terms used herein have the same meaning as commonly understood by one of ordinary skill in the art to which the disclosure belongs.

As used herein, the singular forms "a," "an," and "the" are intended to include the plural forms as well, unless the context clearly indicates otherwise. It will be further understood that the terms "comprises" and/or "comprising," or "includes" and/or "including" when used herein, specify the presence of stated features, regions, steps elements and/or components, but do not preclude the presence or addition of one or more other features, regions, integers, steps, operations, elements, components and/or groups thereof.

Numerous specific details have been set forth herein to provide a thorough understanding of the embodiments. It will be understood by those skilled in the art, however, that the embodiments may be practiced without these specific details. In other instances, well-known operations, components, and circuits have not been described in detail so as not to obscure the embodiments. It can be appreciated that the specific structural and functional details disclosed herein may be representative and do not necessarily limit the scope of the embodiments.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

It should be noted that the methods described herein do not have to be executed in the order described, or in any particular order. Moreover, various activities described with respect to the methods identified herein can be executed in serial or parallel fashion.

Although specific embodiments have been illustrated and described herein, it should be appreciated that any arrangement calculated to achieve the same purpose may be substituted for the specific embodiments shown. This disclosure is intended to cover any and all adaptations or variations of various embodiments. It is to be understood that the above description has been made in an illustrative fashion, and not a restrictive one. Combinations of the above embodiments, and other embodiments not specifically described herein will be apparent to those of skill in the art upon reviewing the above description. Thus, the scope of various embodiments includes any other applications in which the above compositions, structures, and methods are used.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A fuse, comprising:

a fuse body including an elongated body having a first end and a second end, the first end and the second end each having one or more slots;

a fusible element extendable from the one or more slots of the first end of the fuse body to the one or more slots of the second end of the fuse body, wherein the fuse body is formed of an electrically conductive material such that the fusible element is directly connectable to the fuse body; and a cover to at least partially enclose the fuse body and the fusible element, the cover having one or more lockable features to at least partially retain the fuse body, the fusible element, or both.

2. The fuse according to claim 1, further comprising a first electrical conductor disposed at the first end of the fuse body, and a second electrical conductor disposed at the second end of the fuse body, the fusible element being attachable to the first electrical conductor and extendable along the elongated body of the fuse body and attachable to the second electrical conductor.

3. The fuse according to claim 2, wherein the fusible element is attachable to the fuse body, the first electrical conductor, the second electrical conductor, or combinations thereof, by solder, weld, epoxy, winding, forming, or combinations thereof.

4. The fuse according to claim 1, wherein a first slot is disposed on a top surface of the first end of the fuse body, and a second slot is disposed on a top surface of the second end of the fuse body, such that the fusible element is centered along the fuse body.

5. The fuse according to claim 4, wherein at least a portion of a first electrical conductor is positioned in the first slot and at least a portion of a second electrical conductor is positioned in the second slot, the fusible element being attachable to the first electrical conductor in the first slot and the second electrical conductor in the second slot.

6. The fuse according to claim 1, wherein a first slot is disposed on a first side face of the first end of the fuse body, and a second slot is disposed on a second side face of the first end of the fuse body.

7. The fuse according to claim 6, wherein at least a portion of a first electrical conductor is positioned in the first slot and at least a portion of a second electrical conductor is positioned in the second slot, the fusible element being attachable to the first electrical conductor in the first slot and the second electrical conductor in the second slot.

8. The fuse according to claim 6, wherein a third slot is disposed on a third side face opposite the first slot, and a fourth slot is disposed on a fourth side face opposite the second slot.

9. The fuse according to claim 8, wherein the first side face of the first end of the fuse body is opposite the fourth side face of the second end of the fuse body, such that the fusible element is diagonally extendable along the elongated body of the fuse body.

* * * * *